United States Patent [19]

Ford

[11] 4,109,336

[45] Aug. 29, 1978

[54] AUTOMATED MACHINERY TO CLEAN DEBRIS FROM ROADSIDE DITCHES, COLLECT IT AND THEN TRANSPORT THE DEBRIS TO A MAJOR COLLECTING AREA FOR DISPOSING

[76] Inventor: Donald E. Ford, 672 SW. 20th St., Chehalis, Wash. 98532

[21] Appl. No.: 685,367

[22] Filed: May 11, 1976

Related U.S. Application Data

[63] Continuation-in-part of Ser. No. 490,229, Jul. 22, 1974, abandoned.

[51] Int. Cl.[2] ..... E01H 1/02

[52] U.S. Cl. ..... 15/3; 15/80; 15/93 B; 37/82; 37/85

[58] Field of Search ..... 15/78, 80, 4, 93 B, 15/3; 37/81, 82, 85, 91–93, 102, 107, 110, 112, 190

[56] References Cited

U.S. PATENT DOCUMENTS

| | | | |
|---|---|---|---|
| 706,175 | 8/1902 | Hanneborg | 37/82 |
| 1,320,328 | 10/1919 | Haughton | 37/102 |
| 1,654,829 | 1/1928 | Pfeiffer | 37/190 |
| 1,721,392 | 7/1929 | Heumann | 37/81 |
| 3,309,802 | 3/1967 | Baker | 37/85 X |
| 3,452,461 | 7/1969 | Hanson | 37/110 |

*Primary Examiner*—Edward L. Roberts
*Attorney, Agent, or Firm*—Roy E. Mattern, Jr.

[57] ABSTRACT

A vehicle, such as a self dumping dirt truck or a trailer, is equipped with a powered assembly of components to automatically clean debris from roadside ditches or irrigation ditches, preferably powered by the truck engine, a tractor engine, or an auxiliary engine, which in turn drives a hydraulic pump of a hydraulic system powering several hydraulic motors. The debris, dirt, gravel, and weeds, are loosened and collected from the ditches alongside a road and then conveyed to a dirt collecting chamber of the trailer or truck. At times if the debris is not objectionable it may be discharged back near the roadbank but removed from the ditch area. This powered assembly of components comprises: a leading powered auger for rotary and advancing movement in a ditch; a powered cleaner conveyor selectively positioned and operating just behind the auger, which it supports, to convey collected debris up and out of the ditch; a powered bucket elevator to continue conveying the collected debris to a higher elevation on the trailer or truck; a powered belt conveyor to move the collected debris from the bucket elevator to the dirt collecting chamber of the trailer or dirt truck, and an interrelated hydraulic drive system using a hydraulic pump and hydraulic motors, powered by the main engine of the dirt truck or tractor, or the auxiliary engine of a trailer. The powered assembly of the ditch cleaning components is adjustably mounted on the vehicle to be transversely or laterally moved relative to the truck to reach ditches located at different distances from a roadside. Also for legal highway travel, i.e., 8 feet wide, these ditch cleaning components are adjustable into such non-use legal width positions.

6 Claims, 27 Drawing Figures

FIG. 1
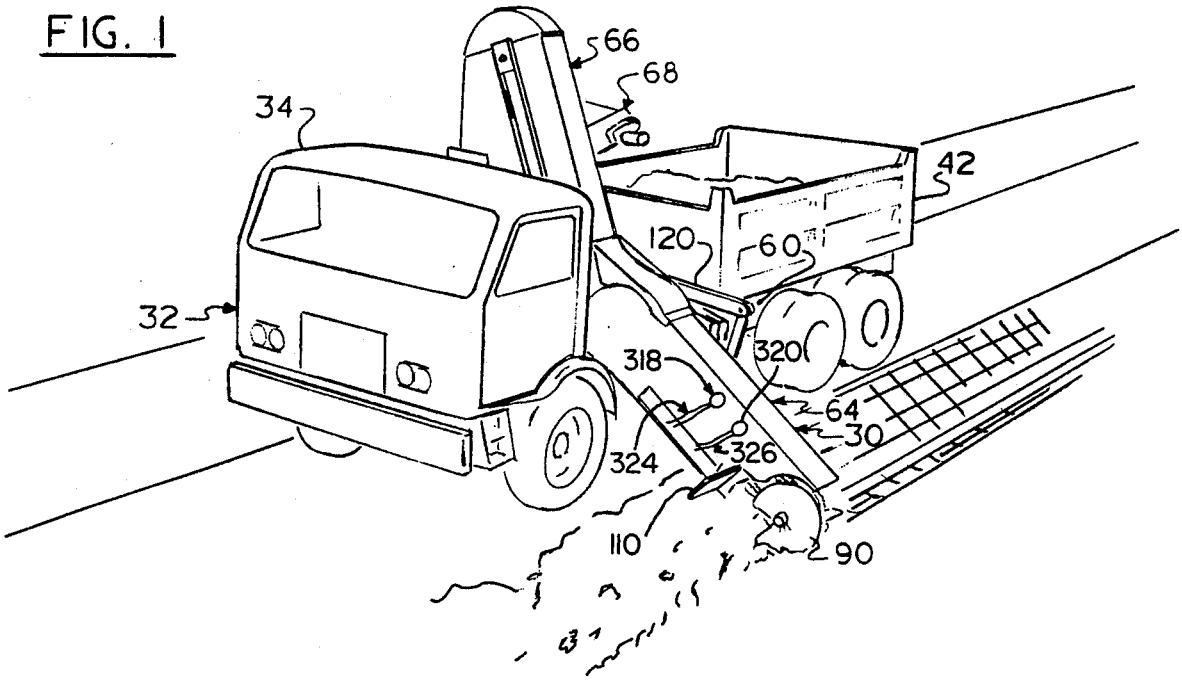
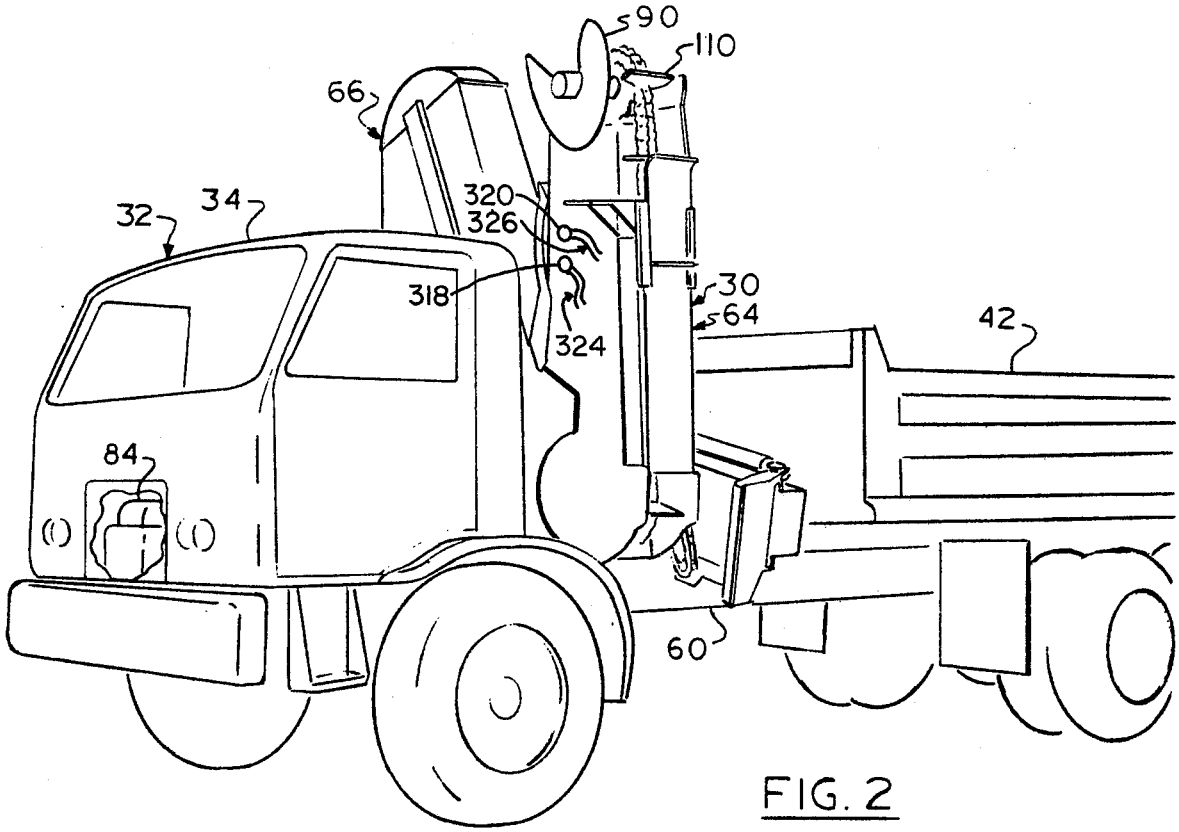
FIG. 2

FIG. 17
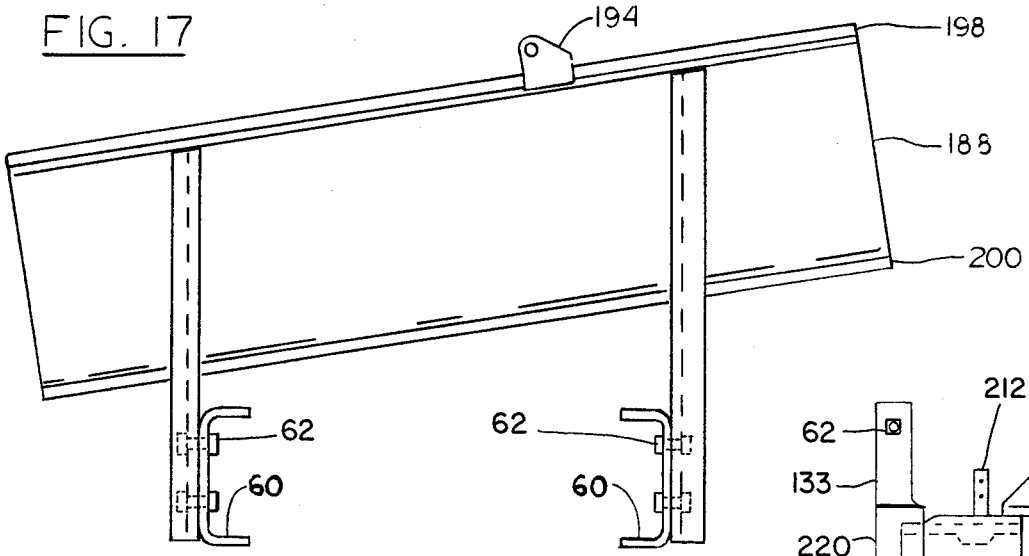
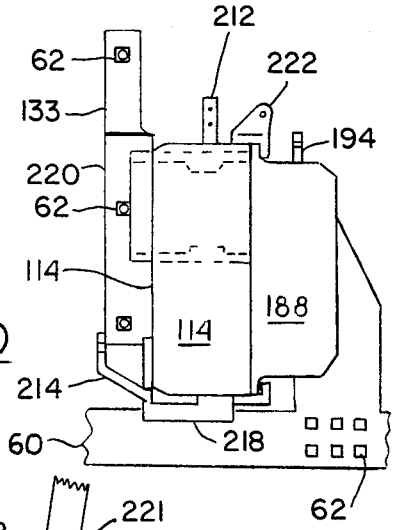
FIG. 20
FIG. 18
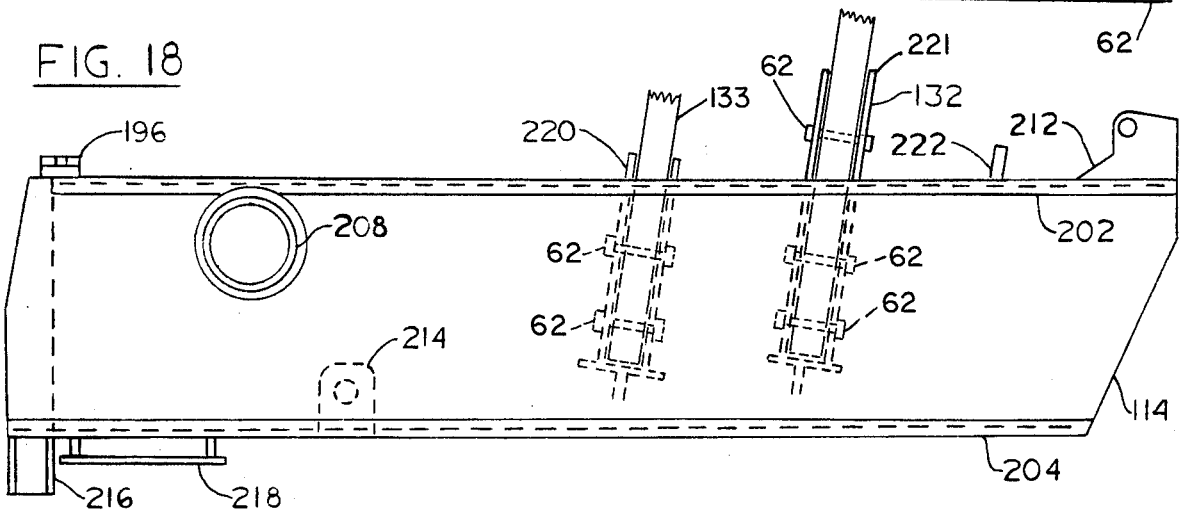
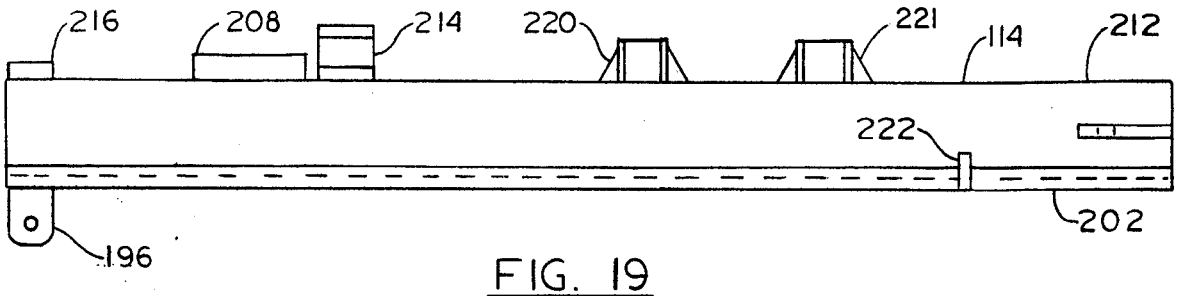
FIG. 19

FIG. 23
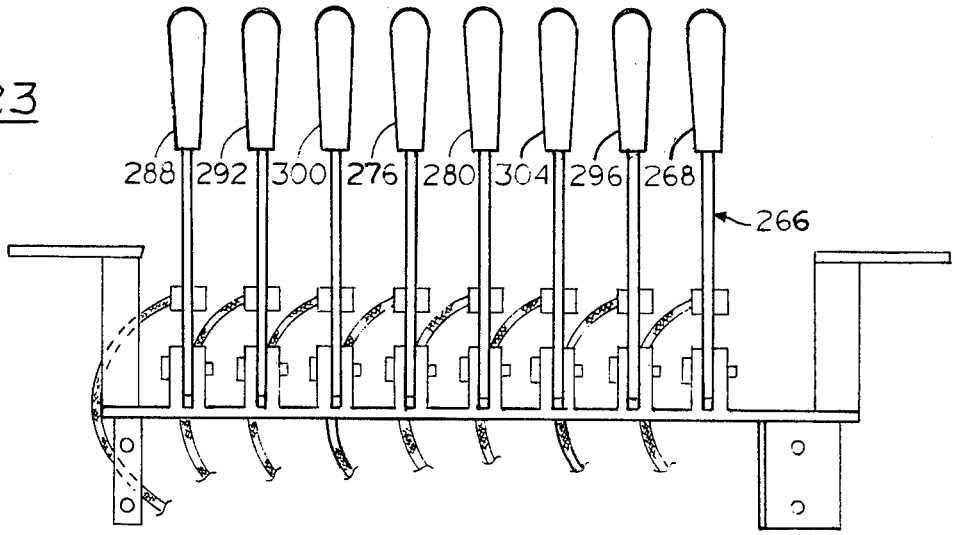
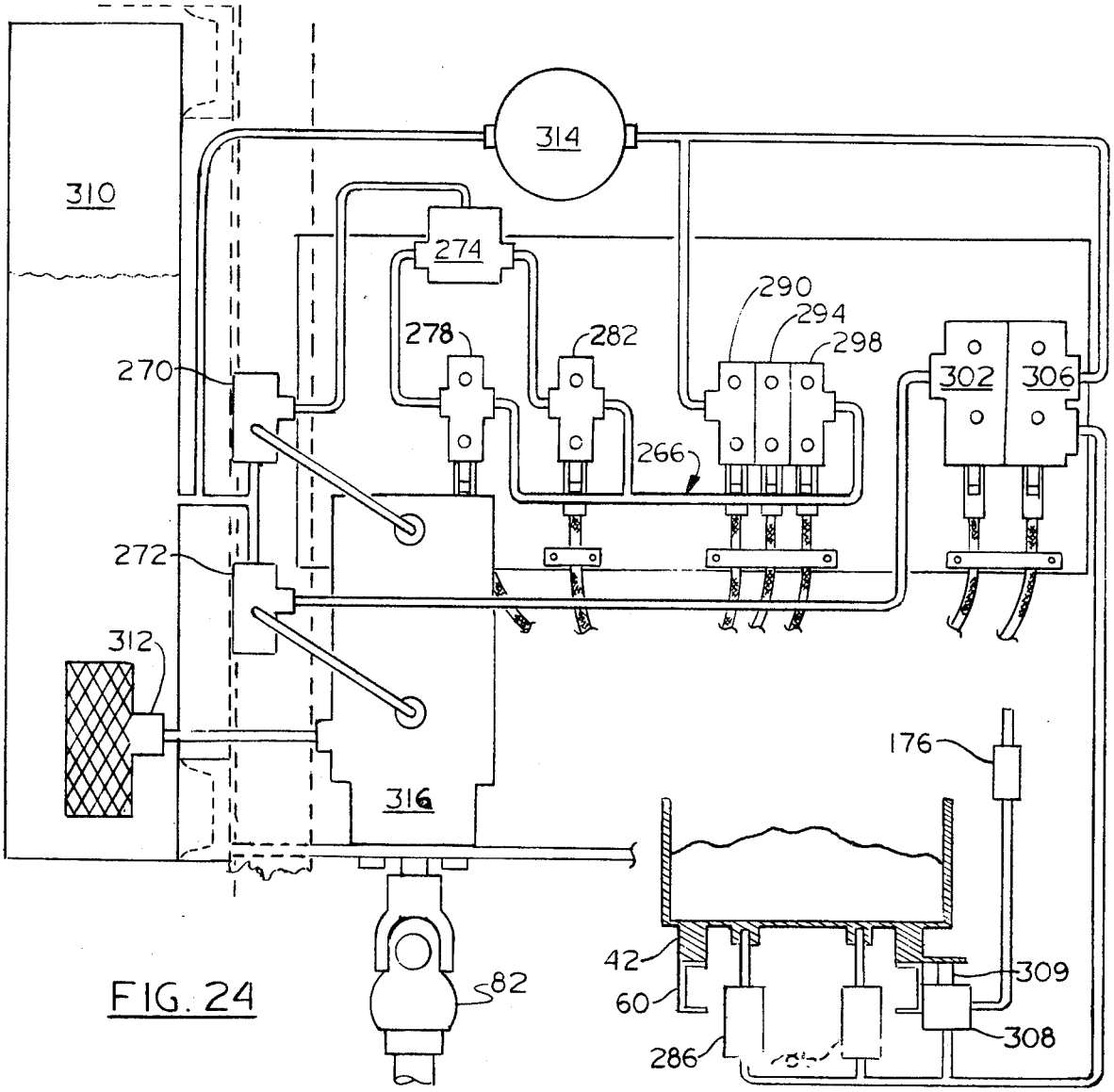
FIG. 24

AUTOMATED MACHINERY TO CLEAN DEBRIS FROM ROADSIDE DITCHES, COLLECT IT AND THEN TRANSPORT THE DEBRIS TO A MAJOR COLLECTING AREA FOR DISPOSING

CROSS REFERENCE

This application is a continuation-in-part application based on the copending application Ser. No. 490,229 filed July 22, 1974 and now abandoned, of same title and same applicant, Donald E. Ford, and priority of the original application is claimed.

BACKGROUND OF THE INVENTION

The cleaning of drainage ditches alongside roadways and highways is generally undertaken by using direct man power of several men employing shovels and rakes to collect debris in spaced piles. These are later shoveled into a dirt truck, which is slowly driven by the piles of debris. Also sometimes, in addition, backhoes and road graders are used. Considerable manpower is used and the cost varies from $600 to $2,000 per mile. Consequently, the overall cleanup is not undertaken too often. Between cleanings sufficient debris may collect causing blockage of the drainage ditch and this blockage is sometimes a contributing cause to a wash out along a road often destroying significant portions of the road.

Although machinery has been designed to create ditches, such as illustrated and described in U.S. Pat. No. 1,183,706 issued in 1916 to D. B. and M. C. Williams, and to create trench excavations, such as illustrated and described in U.S. Pat. No. 3,645,020, issued in 1972 to D. Beslin and B. Beherano, and to plow in a rotary motion, such as illustrated and described in U.S. Pat. No. 2,533,793 issued in 1950 to H. W. Hamlett, and to sweep streets, as illustrated and described in U.S. Pat. No. 1,363,502, issued to Steven Duich in 1920; and to dig and to clean ditches as set forth by E. Heuman in his U.S. Pat. No. 1,721,392 of 1929, and by W. Baker, in his U.S. Pat. No. 3,309,802 of 1967; machinery has not been provided to automatically clean drainage ditches already made and in use, which are not to be basically altered except to be cleaned and the debris removed is fully controlled to be deposited, preferably in the dirt collecting chamber of a dirt truck, on which the ditch cleaning machine is preferably mounted, and such cleaning occurs regardless of the variable spacing of the ditch away from the side of the road on which the truck must remain.

SUMMARY OF INVENTION

The cleaning of drainage ditches alongside roadways and highways without substantially changing their original contour is now undertaken by operating what is to become known, in a short description, as a ditch cleaner. In one embodiment, it is installed on a self-dumping dirt truck with a drivers cab ahead of it, and in another embodiment with a drivers cab behind it. The truck has many standard components, on which an assembly of the ditch cleaner components are mounted, powered, and operated: to loosen debris in a ditch; collect the debris; clean the debris from the ditch; continue raising the debris cleaned from the ditch; redirecting the debris to the rear of the truck and dumping it into the dirt collecting chamber or bed of the truck, before departing from the ditch cleaning operation to travel to the main dumping site. The controls of the truck itself and the controls of the ditch cleaning assembly are located closely nearby so the truck driver will also operate the ditch cleaning assembly while driving the truck as the debris is removed from the ditch and placed in the truck.

Moreover, the essentially automatic ditch cleaner components, in another embodiment, are mounted on a tractor, in an additional embodiment at the rear of a caterpillar vehicle, and in still another embodiment on a trailer, having its auxiliary power unit and connectable to a pickup truck. In regard to these embodiments, they are arranged so a dirt truck may be driven up closely and filled with the debris coming from the ditch. As soon as that dirt truck is filled another is driven up for loading.

In the arrangement and operation of all embodiments, the purpose is to clean ditches thoroughly at a substantially lower cost, as the truck mounted ditch cleaner, per se, cleans the debris from the ditches, completely controlling the debris, keeping it off the road shoulders, and the road itself, as the debris is controllably redeposited in the dirt collecting chamber of the truck or at a designated location, well clear of the ditch, road shoulder, and road. As a result ditches may be cleaned more often avoiding the dam up of debris and the unwanted costly wash out of a road section.

DRAWINGS

The heart of the overall vehicle mounted ditch cleaner, or the cleaning unit itself, is essentially a self-contained unit and has a base member which is bolted or welded to the frame of a vehicle at a preselected location in different embodiments. For movement back and forth in a lateral or transverse direction the ditch cleaner has a slide which moves on a stationary base secured to the vehicle frame. All the other components are thereafter mounted directly or indirectly to the slide.

FIG. 1 is a perspective view of a dirt dump truck with the cab at the front and the automated ditch cleaner mounted on the truck frame behind the cab and forward of the dirt collecting box or chamber, indicating the positioning of the ditch cleaner when a ditch is being cleaned;

FIG. 2 is a perspective view similar to FIG. 1, however, the ditch cleaner is moved to its non use position for highway travel to a ditch cleaning job area;

Figure 4:
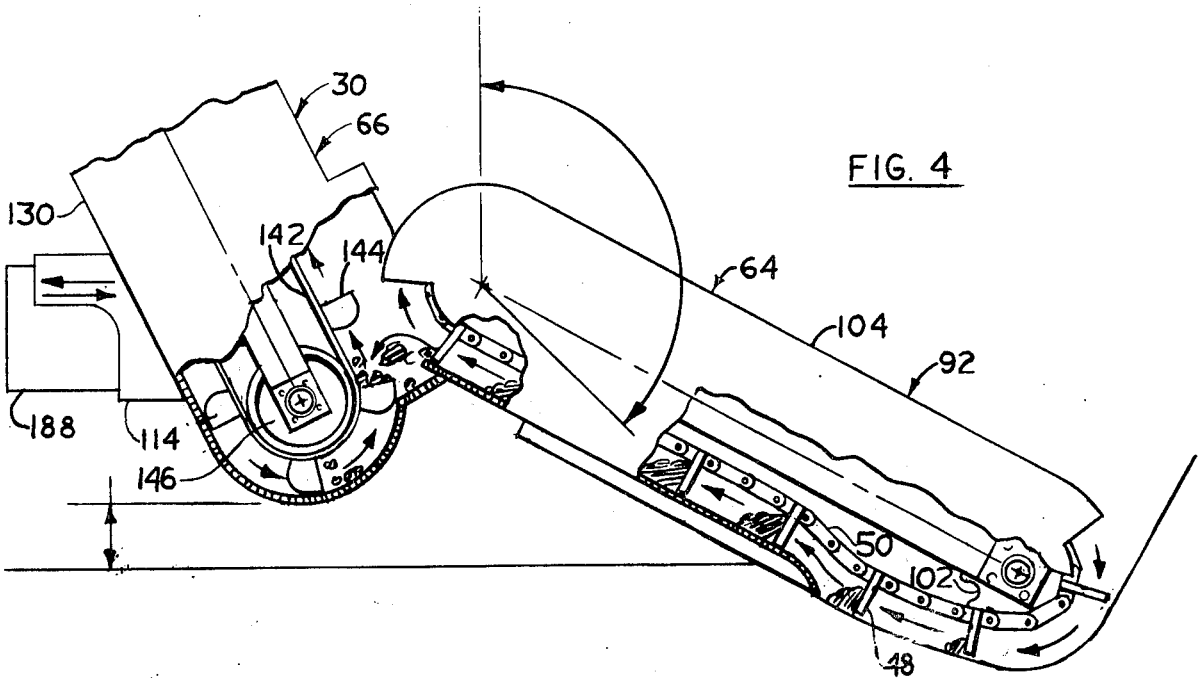
Figure 5:
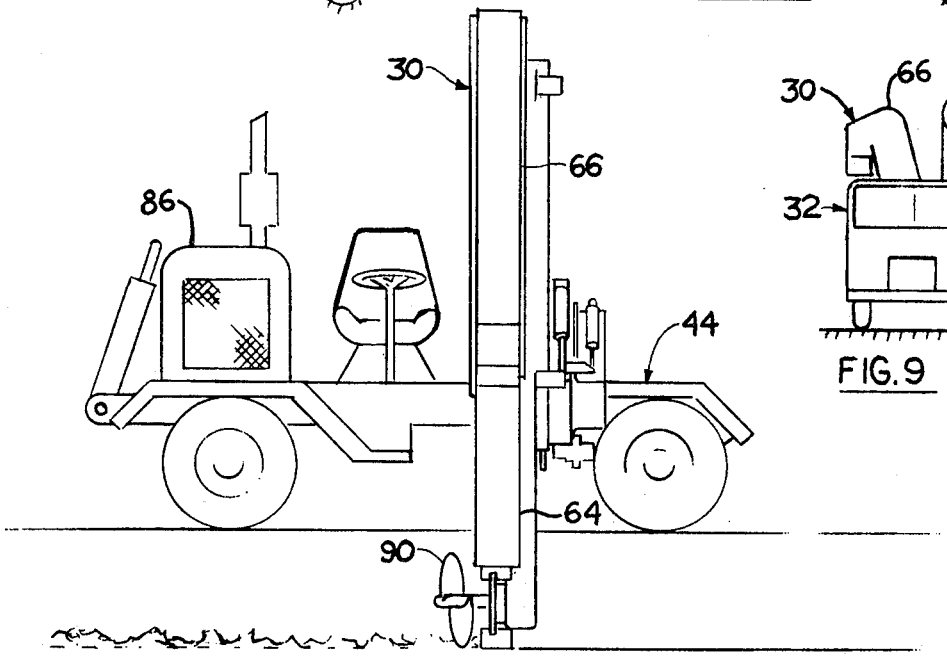
Figure 6:
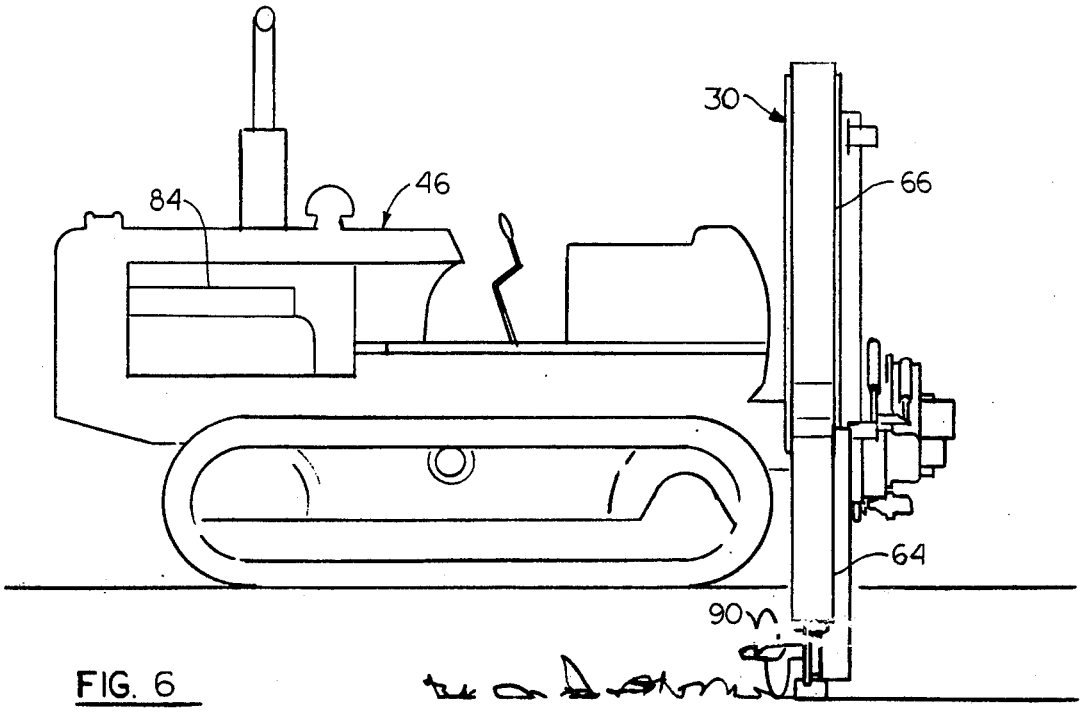

FIG. 4 is a partial cross sectional view of parts of one embodiment of a ditch cleaner further indicating how the loosened debris is handled in the cleaner conveyer commencing its upward travel, and also showing the bucket conveyor raising the debris, the motion arrows showing the conveyor movements, the raising of the cleaner conveyor, and the translation or lateral movement of the ditch cleaners slide along its base, in turn secured to the frame of a vehicle, to move the cleaning conveyor away from and back to a vehicle frame, to reach the centerlines of ditches located at different distances from road edges;

FIG. 5 is a side view somewhat schematically showing how some portions of the ditch cleaner are mounted on the frame of a trailer vehicle which is equipped to be pulled by a pickup truck and which loads dirt trucks as they travel alongside or nearby the trailer;

FIG. 6 is a side view somewhat schematically showing how some portions of the ditch cleaner are mounted on the rear portions of a frame of a caterpillar type vehicle when, for example, irrigation ditches are being cleaned.

Figure 7:
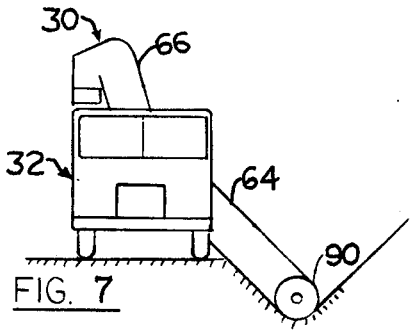
Figure 8:
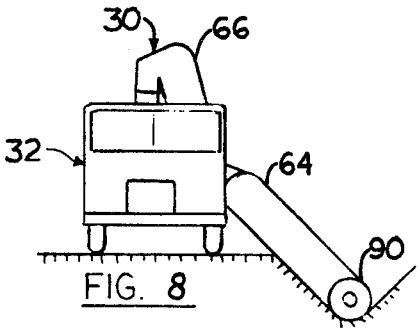
Figure 9:
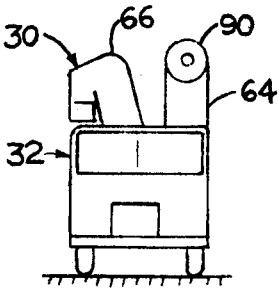
Figure 10:
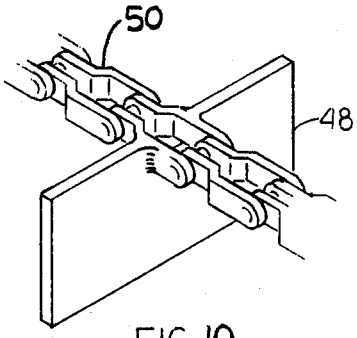
Figure 11:
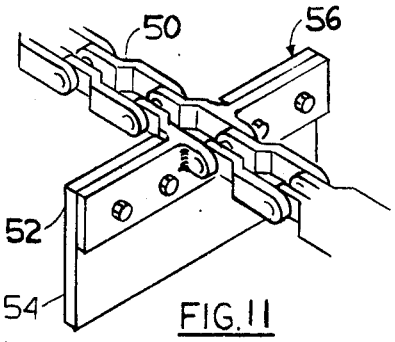
Figure 12:
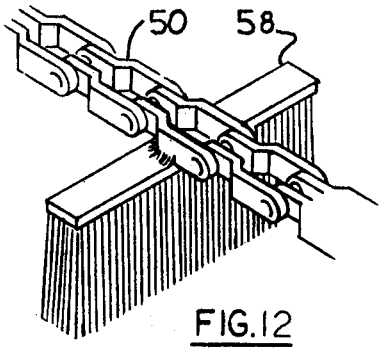
Figure 13:
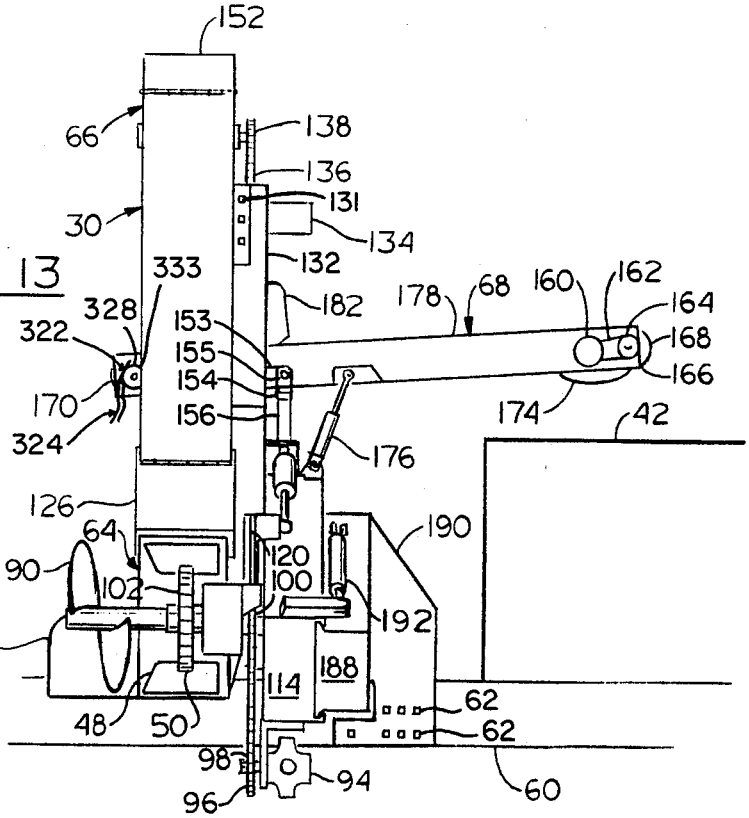
Figure 14:
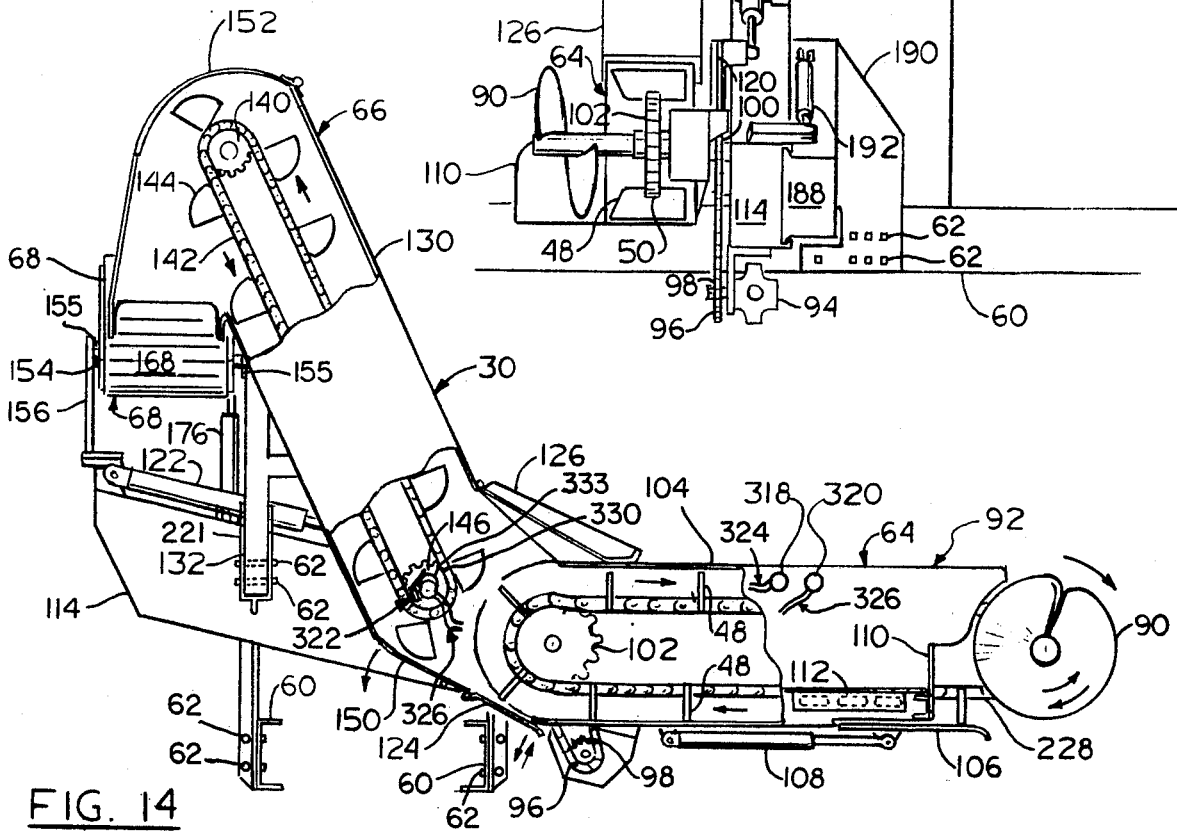
Figure 15:
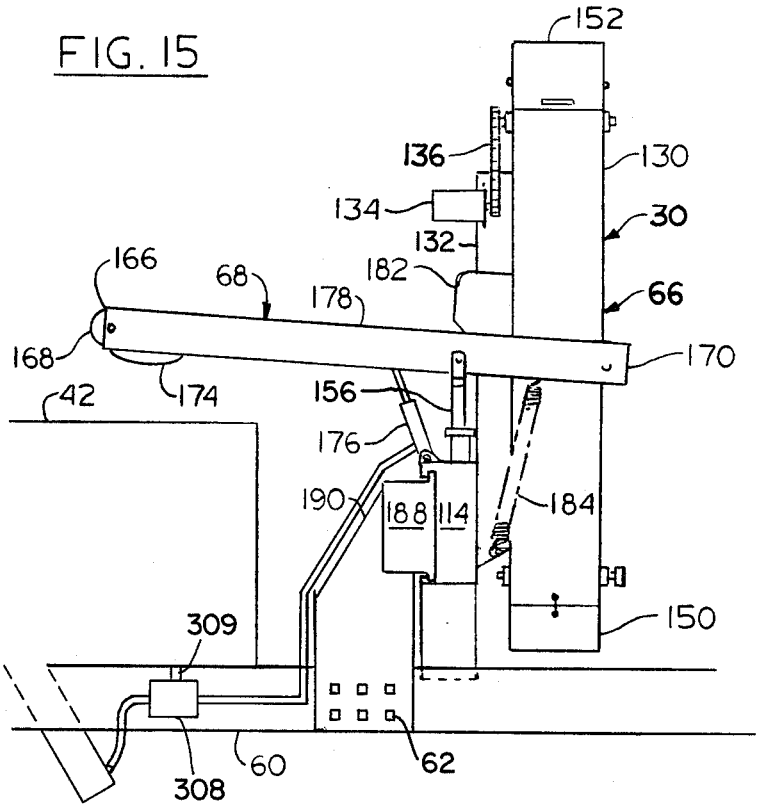
Figure 16:
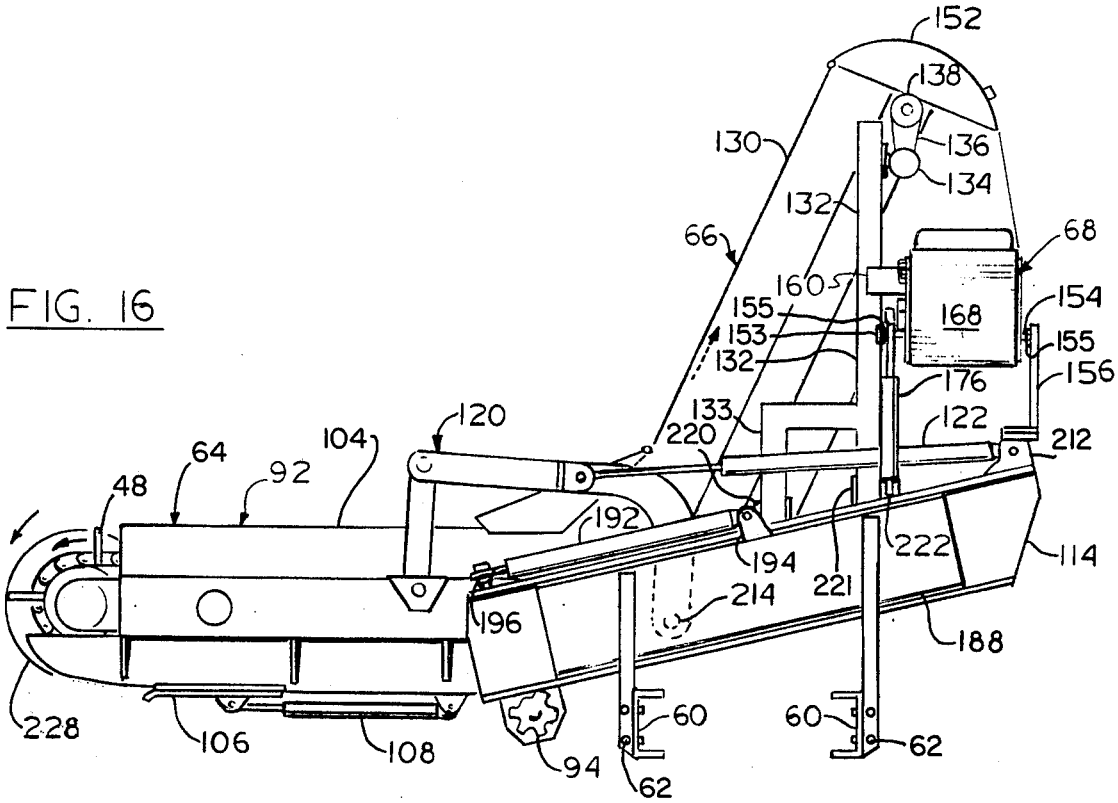

FIGS. 7, 8 and 9 show schematically in front views, the appearance of the front cab truck and ditch cleaner, with FIG. 7 illustrating the cleaning of a nearby ditch, FIG. 8, illustrating the cleaning of a ditch that is farther from the edge of the road, and FIG. 9, illustrating the ditch cleaner stored for regular speed highway travel;

FIGS. 10, 11 and 12, are partial views of the cleaner-conveyor's continuous movable chain showing respective embodiments of the paddles, FIG. 10 illustrating a steel paddle, FIG. 11 illustrating a part steel and part resilient, rubber or rubberlike paddle; and FIG. 12, illustrating a cleaning brush used in lieu of a paddle, but serving a like conveying-cleaning function, where concrete or other hard surface ditches are to be cleaned;

FIG. 13 is a somewhat schematic left side view or the auger side view of the preferred embodiment of the ditch cleaner, and portions of a vehicle, indicating the mounting of its base to the frame of the vehicle and the positioning of the ditch cleaner with respect to the box or debris collecting chamber of the vehicle;

FIG. 14 is a somewhat schematic front view of the preferred embodiment of the ditch cleaner with portions removed, with motion arrows, for example, to indicate the direction of motion of the auger, cleaner-conveyor, and bucket conveyor, and showing how the ditch cleaner is secured to the frame of the vehicle;

FIG. 15 is a somewhat schematic right side view, or the opposite auger side view, of the preferred embodiment of the ditch cleaner, and portions of a vehicle, indicating the mounting of its base to the vehicle frame and its position with respect to the box or debris collecting chamber of the vehicle;

FIG. 16 is a somewhat schematic rear view of the preferred embodiment of the ditch cleaner, with motion arrows, for example, to indicate the direction of motion of the auger, the pivoting of the cleaner-conveyor, and the transverse positioning of the slide relative to the base.

Figure 21:
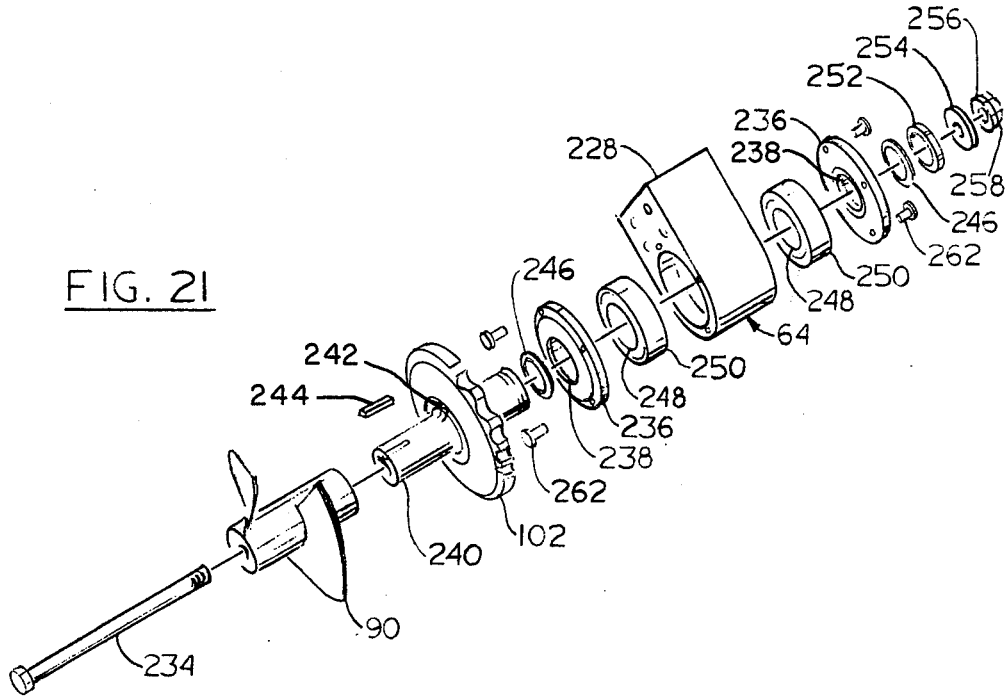
Figure 22:
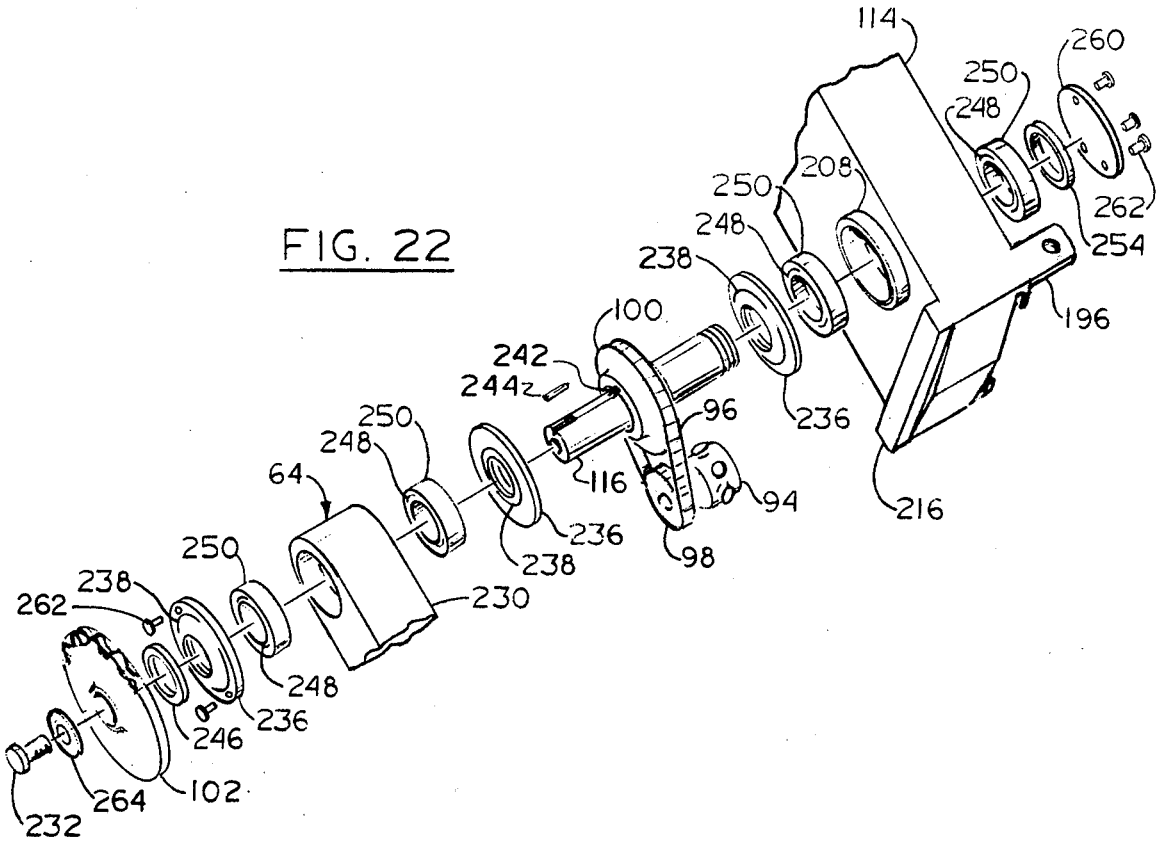
Figure 25:
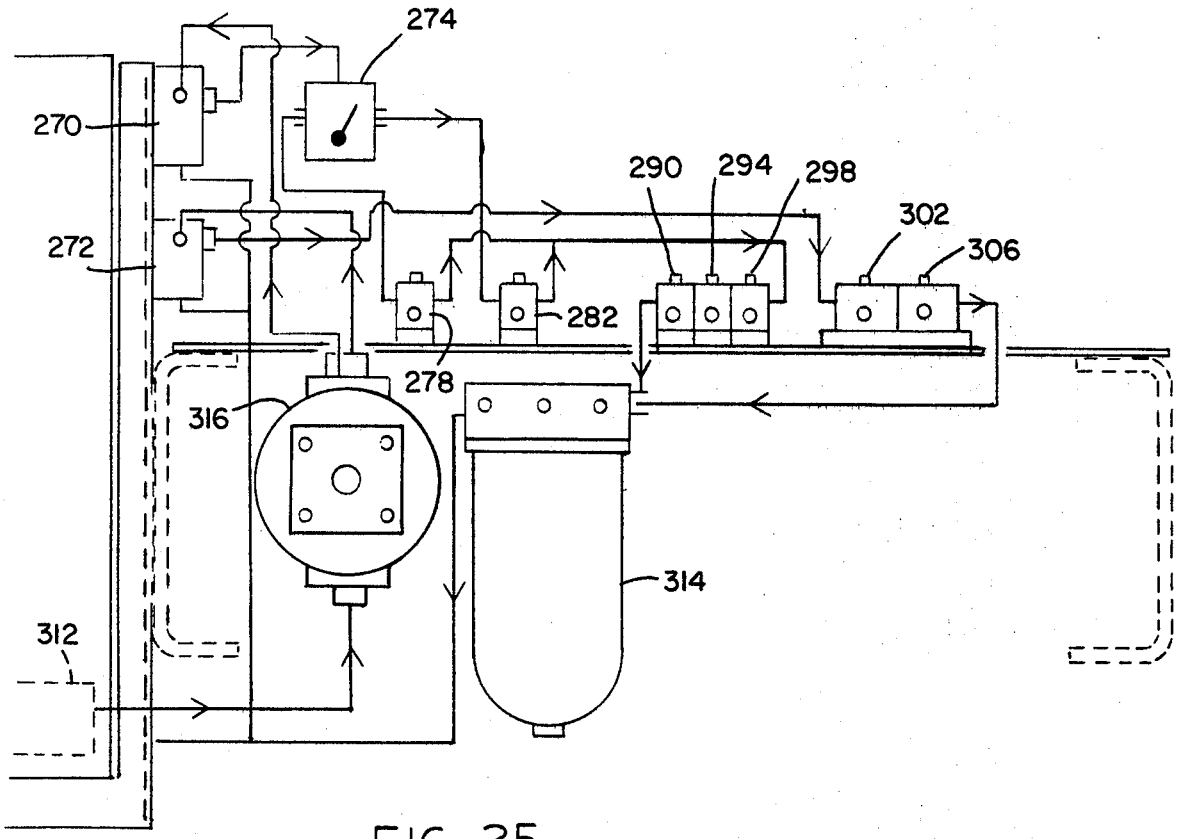

FIG. 17 is a rear view of the base of the ditch cleaner bolted to the vehicle frame shown in section;

FIG. 18 is a rear view of the slide before its mounting on the base of the ditch cleaner;

FIG. 19 is a top view of the slide before its mounting on the base of the ditch cleaner;

FIG. 20 is a side view, partially in section of the subassembly of the slide on the base of the ditch cleaner, with the base bolted to a vehicle frame, shown in part;

FIGS. 21 and 22 are somewhat schematic exploded views, respectively, of the auger end or intake end of the cleaner-conveyor, or digging conveyor, or digging arm, and the end opposite the auger end or discharge end of this same conveyor, to illustrate how this conveyor is made, assembled, and mounted on the slide of the ditch cleaner;

FIGS. 23, 24 and 25 are somewhat schematic views, respectively, of the hydraulic system controls operated by the person running the ditch cleaner from his control position above, and of the hydraulic system components located below and secured directly and indirectly to the frame of the vehicle, FIG. 24 being a top schematic view and FIG. 25 being an elevational schematic view.

Figure 26:
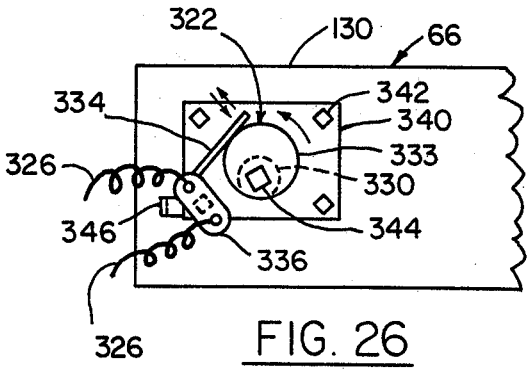
Figure 27:
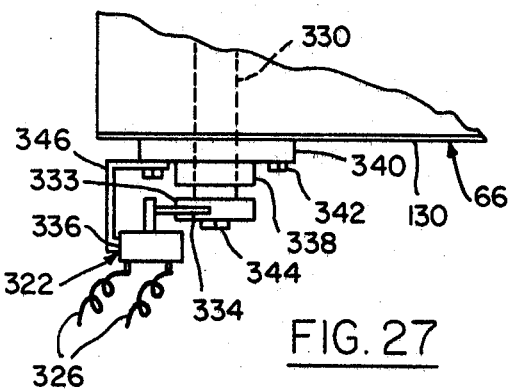

FIG. 26 is a partial elevational view and FIG. 27 is a partial top view, both views indicating how an operational and/or warning light is continually switched on and off by the rotation of a cam which deflects the actuating arm of a light switch.

DESCRIPTION OF THE PREFERRED EMBODIMENTS

THE DITCH CLEANER IS MOUNTABLE ON THE FRAMES OF MANY DIFFERENT TYPES OF VEHICLES

As illustrated in FIGS. 1, 2, 3, 5 and 6, the ditch cleaner 30, as an assembly of components to be powered, and then upon movement of a vehicle, to become automated machinery to clean debris from roadside ditches, is mountable on different types of vehicles. When the ditch cleaner 30, is mounted on front cab truck 32, behind the cab 34 as shown in FIGS. 1 and 2, or mounted at the front 36 of a hood 38 of the truck 40, illustrated in FIG. 3, then the debris loosened and withdrawn from the roadside ditches is collected in the respective collecting chambers 42, or box 42, of these trucks 32, 40 and transported to disposal areas. When the ditch cleaner 30 is mounted on the trailer 44, illustrated in FIG. 5, or the caterpillar vehicle 46, shown in FIG. 6, the debris removed from the ditch, either a roadside ditch or an irrigation ditch, will be redeposited adjacent to the ditch or deposited in another vehicle or trailer pulled alongside having a collecting chamber or box 42.

THE SIMILAR BASIC OPERATION OF ALL EMBODIMENTS OF THE DITCH CLEANER

Whether the ditch cleaner 30, is mounted on the vehicles shown in FIGS. 1, 2, 3, 5, and 6, or other vehicles, the overall function is essentially the same, as shown in FIGS. 1, 3, 4, 7, 8, and 9. As schematically illustrated in FIGS. 7, 8 and 9, the ditch cleaner 30, mounted on a front cab truck 32, is respectively at low speed cleaning a ditch nearer to the roadside, at low speed cleaning a ditch farther from the roadside, and compactly stored away for higher speed travel to or from a ditch cleaning location or area.

Figure 3:
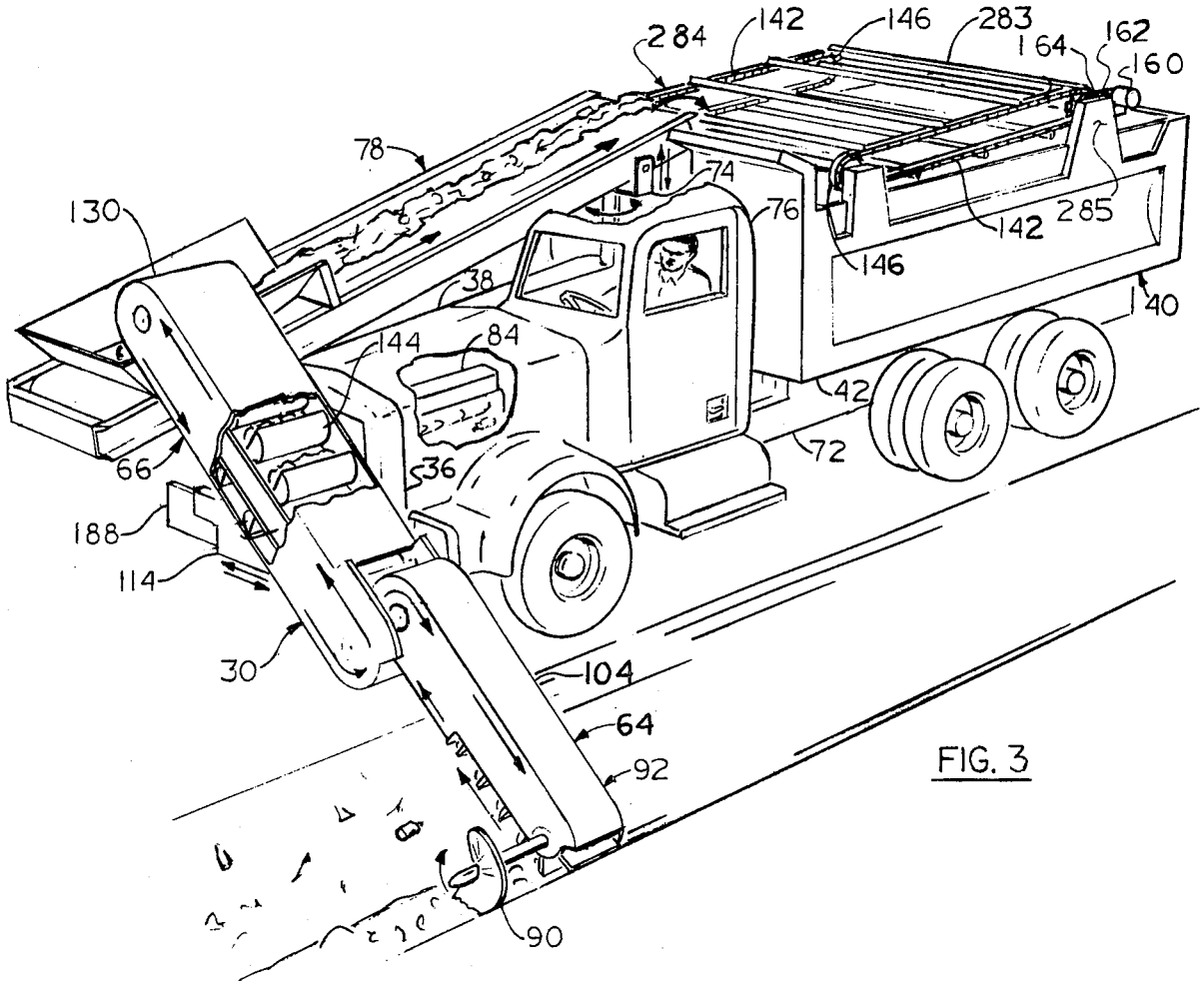
FIG. 3 is a perspective view of another dirt dump truck with the automated ditch cleaner mounted on the truck frame which is extended beyond the hood of the truck engine, the cab therefore being behind the ditch cleaner; and the motion arrows indicate the operation of the ditch cleaner in removing debris from a roadside ditch and conveying it to the box or debris collecting chamber of the truck.

As shown in FIGS. 3 and 4, with motion arrows indicating translation motions to reach ditches farther away, pivoting motions to move down into deeper ditches and retract back upwardly, auger rotation motions, outboard, central, and longitudinal conveyor motions, the ditch cleaner 30, effectively and automatically, loosens the debris and raises it upwardly for rehandling, preferably depositing the debris in a collection chamber 42, for transport to a disposal area.

VARIOUS TYPES OF BLADES FOR VARIOUS TYPES OF DITCHES TO BE CLEANED

Most of the roadside and irrigation ditches to be cleaned will essentially be previously and initially formed from earth without further improvements, and later when these ditches are cleaned by the ditch cleaner 30, an all metal paddle 48 will be used to collect the debris loosened by the auger 90 and direct it within the cleaner conveyor 64. It will be welded to the endless chain 50 of an outward conveyor, as illustrated in FIG. 10. However, there will be times when the previously and initially formed ditch will have additional improvements such as concrete and/or metal drains, concrete and/or asphalt bottom and/or sidewall liners. When such improved ditches are to be cleaned, the combined metal 52 and resilient rubber or rubber like material 54 blade 56, shown in FIG. 11, or the brush 58, shown in FIG. 12, will be used at spaced locations along the endless chain 50 of a conveyor.

THE ENTIRE DITCH CLEANER ASSEMBLY MOUNTED ON A FRAME OF A TRUCK HAVING A FRONT CAB BEHIND THE CAB AND AHEAD OF ITS COLLECTING CHAMBER OR BOX

In FIGS. 13 through 24, a preferred embodiment of a full ditch cleaner assembly 30 is illustrated, which is particularly suited for installation on a front cab truck 32 and secured to the truck frame 60 behind the cab 34. FIGS. 13 through 16, show the full assembly of the ditch cleaner 30, respectively, viewed from the left side, front, right side, and rear. FIGS. 17 through 20, illustrate in more detail how the ditch cleaner 30 is secured to the frame 60 of truck 32 by using bolt and nut assemblies 62, and where the various supports and actuators are secured within the ditch cleaner assembly 30.

This same frame mounting using like components is utilized in mounting the ditch cleaner 30 to the front of the truck 40, illustrated in FIG. 3, when its frame 72 is extended forwardly to receive the ditch cleaner 30. Also, when necessary, an additional swiveling and pivoting guiding support 74 is secured to the frame 72 behind the cab 76 and ahead of the collecting chamber or box 42, to support the extended longitudinal or belt conveyor 78.

FIGS. 21 and 22, in exploded views, indicate preferred arrangements of the mounting and rotational parts of one conveyor, referred to as the outward, or cleaner, conveyor 64. The other conveyors are like conventional bucket conveyors and belt conveyors, and they are called the central, lifting, elevation, or bucket conveyor 66, and the longitudinal, distribution, or belt conveyor 68.

In FIGS. 23, 24, a preferred hydraulic control and hydraulic power distribution system is schematically illustrated based on taking the rotative power of a driven power take off shaft 82 of an engine, either the main engine 84 of a truck 32, 40 or caterpillar vehicle 46, or an auxiliary engine 86 of a trailer 44. The hydraulic cab controls are shown in FIG. 23, and the balance of the hydraulic control and hydraulic distribution components are illustrated in FIG. 24.

THE DITCH CLEANING AUGER AND THE OUTWARD, OR CLEANER, CONVEYOR

As illustrated, particularly, in FIGS. 13, 14, 16, 21 and 22, the ditch cleaning auger 90 and the outward conveyor 64, also referred to as the cleaner conveyor 64, are moved and powered together as a subassembly 92, using hydraulic motor 94 and its power drive chain 96 and drive sprocket 98 and driven sprocket 100, shaft 116 and sprocket 102. As particularly shown in FIGS. 10 and 14, metal paddles 48 are welded at spaced intervals along a continuous, endless digging chain 50 driven around the driven cleaning chain sprockets 102. As illustrated in FIGS. 3 and 4, as this outward, or cleaner, conveyor 64 operates, the auger 90 rotates to loosen the debris and the paddles 48 push and guide the debris upwardly through the housing 104 of conveyor 64.

To compensate for how far the metal paddles 48 may be directly effective in scraping the ground surfaces of the ditch and adjacent road shoulder, a ditch shoe 106 is translated in and out along the bottom of the housing 104 by a hydraulic actuator 108. At all times the purpose is to gather the debris up as soon as possible from the ditch and nearby road bank so it will be controllably conveyed away by the outward or cleaning conveyor 64, thereby eliminating any need for cleaning up unnecessarily the road bank or the road itself. Also attached to this ditch shoe 106 is a vertical shield 110 to combine with the ditch shoe in preventing a berm and to deflect rocks that might otherwise go on to damage the ditch cleaner 30 and/or hurt the operator.

To pivotally move the cleaning conveyor 64 down into a ditch or raise it up for higher speed highway travel, at the legal 8 foot overall width, as illustrated in FIGS. 1, 2, 8 and 9, it is pivotally attached to a slide frame member 114 using a mounting shaft 116, and it is moved using a pivoting arcuate lift beam subassembly 120 which in turn is powered by the lift hydraulic cylinder 122, the mounting shaft 116, being shown in FIG. 22, and the lift beam subassembly 120, being shown in FIG. 16. The lift beam subassembly 120 is pivotally secured by anchor 214, between the slide frame 114 and the housing 104 of the outward, cleaner, conveyor 64. The lift hydraulic cylinder 122 is secured between the slide frame 114 and the arcuate lift beam subassembly 120, as illustrated in FIG. 16.

To insure, during the cleaning conveyor pivotal movements, while ditch cleaning operations are underway, that debris will not be unwantedly dropped down on the road or shoulder, a spring loaded pivotal door 124 secured to the bucket, lifting, or elevator conveyor 66 continuously bears against the bottom of the housing 104 of the cleaning conveyor 64. Also above, a hinged cover 126, continuously bears against the top of the housing 104 of the cleaning conveyor 64 to also insure the debris will be pushed into the path of the bucket, lifting or elevator conveyor 66 and not elsewhere where it is not wanted. In addition along the bottom of the front side of the housing 104 is another movable member 112 to be opened up when dislodging any rock that may be jammed.

THE BUCKET, LIFTING, ELEVATION CONVEYOR

As shown in FIG. 16, the bucket conveyor, also referred to as a lifting, or elevation, conveyor 66, has its housing 130 secured to an upstanding frame 132 with offset leg 133, which in turn is removably secured by bolting assemblies 131, to the slide frame 114 by using receiving structures 220 which are welded to the slide frame 114. The members 114 and 132 together comprise a slide frame structure. A hydraulic motor 134 with its roller chain drive 136 and driving sprocket 138, powers the driven sprocket 140 inside the bucket conveyor 66, to thereby move the endless double pitch chain 142, its secured, spaced, plastic buckets 144, and the chain driven sprocket 146. These buckets 144 are moved through the debris being pushed and deposited by the cleaning conveyor paddles 48, to pick up a load of debris for its elevation and subsequent deposit on the longitudinal or belt conveyor 68.

The housing 130 of the bucket conveyor 66 is equipped with a lower clean out door 150 and a top inspection and access door 152. Also the housing 130 pivotally supports lower pivotal spring loaded door 124, which bears against the housing 104 of the digging conveyor 64, and it pivotally supports the hinged cover 126, which bears down on the top, shroud or cover, of the housing 104 of the cleaning conveyor 64.

THE BELT, LONGITUDINAL, CONVEYOR

As shown in FIGS. 13 through 16, when the debris that is elevated in the buckets 144 of the bucket conveyor 66, is to be guided further for deposit, such as in the debris collecting chamber 42 or box 42 of a truck 32, 40, a belt conveyor 68, also referred to as longitudinal conveyor 68, is operated. It is pivotally supported on shaft 154 in turn supported at one of its ends using a bearing socket 155 secured on an upstanding frame 156, which in turn is secured to the slide frame 114 and at its other end using a bearing socket 155 and a bracket 153 secured to the frame 132. A hydraulic motor 160 with its roller chain drive 162 and driving sprocket 164, powers the power roller 166 of the belt conveyor 68, and the movement of the belt 168 continues around its non power roller 170.

The power roller end or discharging end of this belt conveyor 68 is equipped with a protective cam shoe 174 to avoid damage by any contact made between this conveyor 68 and the box 42 of the truck 32. The angular or pivotal position of the belt conveyor 68 is adjusted upon operation of the hydraulic cylinder 176, which is pivotally secured between the frame 178 of the belt conveyor 68 and the slide frame 114. Before the debris collecting chamber 42 or box 42 of the truck 32 is pivotally raised to dump the collected debris, the hydraulic cylinder 176 must be actuated to pivotally raise the belt conveyor 68 clear of the path of the pivoting box 42. This sequence is assured by the arrangement of the overall hydraulic system. During this pivoting of the belt conveyor and at all times, a counter balance coiled tension spring 184 dampens and helps to control the positioning of the belt conveyor 68. This spring 184 is secured between the frame 178 of the belt conveyor and the vertical frame 132 supporting the bucket conveyor 66. To keep the debris falling down from the buckets 144 from occasionally spilling over and out of the path of the belt conveyor a shield 182 is secured to the housing 130 of the bucket conveyor 66, as shown in FIG. 15.

THE TRANSLATION OF SUBSTANTIALLY THE ENTIRE DITCH CLEANER TO CLEAN DITCHES LOCATED AT DIFFERENT DISTANCES FROM THE EDGE OF THE ROAD

As noted in FIGS. 7 and 8, ditches are not located at a standard distance away from the edges of the road, so as shown in FIGS. 3 and 4, with motion arrows, there is relative transverse movement between the ditch cleaner 30 and a truck 40. As illustrated in FIGS. 16, 17, 18, and 19, this transverse movement is taken care of in the ditch cleaner 30 itself. A slide frame 114 is made for controlled sliding movement along a base 188, in turn secured by brackets 190 or plates 190, which are welded to the base 188 and bolted to the frame of a vehicle, such as the frame 60 of truck 32, or frame 72 of truck 40.

In FIG. 16, the hydraulic actuator 192 is shown, which supplies the extending and retracting power to move the slide frame 114 relative to the base 188, and thereby to move the ditch cleaner over ditches located at different distances from the roadway edges. The hydraulic actuator 192 is secured to the base 188 by anchor 194 and secured to the slide frame 114 by anchor 196. Other than the anchor 194 for hydraulic actuator 192, the base 188 has no other securement places except for its continuous top and bottom flanges or rails 198, 200, which slidably interfit with the overlapping top and bottom guides 202, 204 welded to the slide 114.

In contrast, the slide 114 has several mounting places for all the translating components of the ditch cleaner 30, as illustrated in FIGS. 18, 19 and 20. There is a mounting hub 208 to receive the bearing mounting of the shaft 116, which supports, in turn, the cleaning conveyor 64. As noted before, anchor 196 on slide 114 receives the other end of the transverse extending and retracting hydraulic actuator 192. On slide 114, at its top, the lift hydraulic actuator 122 is secured to anchor 212. At its bottom, the slide 114 pivotally receives at its anchor 214, the lower end of the pivoting arcuate lift beam subassembly 120, which is used in rotating the outward cleaning conveyor 64 and avoiding any excessive bearing load pressure on the relative pivoting parts of the conveyor 64 and slide 114. A thrust plate 216 for receiving any thrust from the cleaning conveyor housing 104 is attached to slide 114. A hydraulic motor mounting plate 218 is welded to slide 114. Also projecting upwardly from slide 114 is upstanding vertical frame support 132, fitted to receiving structures 220/221. In addition the base of the hydraulic cylinder or actuator 176, which pivotally moves the belt conveyor 68, is secured to slide 114 at anchor 222. Therefore, when the hydraulic actuator 192 moves the slide 114 relative to the base 188, the slide moves together all the other cofunctioning components of the automatic ditch cleaner 30 to translate them to and from a ditch centerline.

PREFERRED EMBODIMENTS OF THE VARIOUS COMPONENTS MOUNTED AT THE OUTBOARD AND INBOARD HEADS OR ENDS OF THE CLEANING CONVEYOR

As noted earlier, the bucket and belt conveyors 66, and 68, are considered more conventional in function, although they are specifically designed for this ditch cleaner 30. However, the cleaner conveyor 64, because of its unusual function and its capability to be pivoted to reach different ditch locations and depths, and also to be pivoted to an upward higher speed high travel position, within the legal 8 feet highway width, is considered non conventional in function. Therefore, in FIGS. 21 and 22, in exploded views the various components of this cleaning conveyor 64 are illustrated in respect to the outboard head or end 228 and inboard head or end 230. From viewing these exploded views of FIGS. 21 and 22, the purpose and function of the components will be realized. Therefore they are listed by name and numeral as follows, in FIG. 21: tie rod 234, auger 90, driven cleaning chain sprockets 102, seal housing 236, seal 238, auger shaft 240, key way 242, key 244, shaft sleeve 246 for seal, bearing 248, bearing cup 250, lock 252, nut 254, end cap 256, and nut 258; and in FIG. 22: cap screw 262, washer 264, driven cleaning chain sprocket 102, nut 254, seal housing 236, seal 238, bearing 248, bearing cup 250, inboard head 230, digging conveyor 64, mounting shaft 116, hydraulic motor 94, drive chain 96, driving sprocket 98, driven sprocket 100, hub or bearing housing 208 shaft sleeve 246, key way 242, key 244, bolts 262, and slide 114, and also bolt 232 and cover 260.

HYDRAULIC SYSTEM FOR CONTROLLING, POWERING AND ACTUATING THE DITCH CLEANER

The preferred embodiment of a hydraulic system 266 for controlling, powering, and actuating the ditch cleaner 30 is schematically illustrated in FIGS. 23, and 24. In the respective cabs of trucks 32, 40, or other vehicles, there are, for example, eight hand actuated controls. Hand control 268 is an optional handle that can be used either as a replacement for one of the other controls in case of damage or for optional equipment, such as the debris load leveler 284 on collecting chamber or box 42, as shown in FIG. 3. It is to be noted now that valves 270, 272, 274 are automatic flow controls for the overall system and determine the selected flow direction at a selected volume of hydraulic oil. However, the other valves are controlled when the hand controls are moved or actuated. Hand control 276, via valve 278, controls the bucket conveyor hydraulic motor 134. Hand control 280, via valve 282, controls the belt conveyor hydraulic motor 160. Hand control 288, via valve 290, operates the hydraulic actuator 192, which moves the slide 114 relative to base 180 of the ditch cleaner 30. Hand control 292, via valve 294, controls movement of hydraulic actuator 122, in turn, moving the pivoting arcuate lift beam subassembly 120, which thereafter positions the cleaner conveyor 64. Hand control 296, via valve 298, operates hydraulic actuator 108 which moves the ditch shoe 106 on the cleaning conveyor 64. Hand control 300, via valve 302, operates the hydraulic motor 94 which drives both the cleaning conveyor 64 and the auger 90. Hand control 304, via valve assembly 306, first operates the hydraulic actuator 176 to pivot the belt conveyor, and then operates the vehicle's hoist to dump the debris collection chamber 42. The hydraulic fluid is circulated back and forth through tank 310, and filters 312, 312. The entire hydraulic system obtains its pressure via hydraulic pump 316, which is driven by the engine 84 of a vehicle, using a power take off shaft 82.

THE FEATURE OF THE HYDRAULIC SYSTEM OF SPECIFIC CONTROL WITH RESPECT TO FIRST MOVING THE BELT CONVEYOR OUT OF THE WAY, BEFORE RAISING THE DEBRIS COLLECTING CHAMBER

Upon movement of hand control 304, valve 306 is moved, and hydraulic pressure and flow are applied at the time to the box hoists cylinders 286, and through the box actuated valve 308, to the hydraulic actuator 176. Therefore, the belt conveyor, being the lightest is raised out of the way to the limit of travel of its actuator 176, where it stays, while the full hydraulic pressure operates the box hoist cylinders 286, in turn raising the box 42 to dump the debris. Also upon the box 42 raising, it clears a plunger 309 of the box actuated valve 308, shutting off the hydraulic oil circuit leading to the actuator 176 of the belt conveyor 68, thereby preventing the actuator 176 from lowering the belt conveyor 68 until after the box 42 is again back in place depressing the plunger 309 of valve 308, opening the hydraulic circuit releasing all pressure and lowering the belt conveyor 68.

OPTIONAL DEBRIS LEVELING ASSEMBLY

As shown in FIG. 3, an optional debris leveling assembly 284 is mounted on the top of collecting chamber or box 42 to drive leveling bars 283 into the forming debris pile to level their tops towards the rear of the box 42. It is driven by hydraulic motor 160, mounted on bracket 285, roller chain drive 162, driving sprocket 164. The driven sprockets 146 and driven chain 142 are similar to the driven sprockets 146 and driven chain 142 of the bucket conveyor. This optional debris leveling assembly 284 is controlled by moving the control handle 268.

OPERATIONAL LIGHTS TO INDICATE CONVEYORS ARE RUNNING AND/OR STOPPED

As viewed in FIG. 14, dual set of operational lights, 318, 320, are mounted on the housing 104 of the cleaning conveyor 64. Preferably during operation of the bucket conveyor 66 and the belt conveyor 68 respective, these green and amber lights 318 and 320 will be constantly blinking to indicate the conveyors correct operations. However when either conveyor stops because of plugging or overload, its respective light 318 or 320 will stop blinking informing the operator of trouble on ditch cleaner 30, so he may immediately take corrective action before trying to continue the ditch cleaning operations. These lights are positioned to be conveniently viewed by the operator, while he is also viewing the operation of auger 90 being simultaneously driven with the cleaner conveyor 64.

In FIGS. 14, 26, and 27, the cam-switch assembly 322 and circuit wires 324 to the belt conveyor and battery, and circuit wires 326 to bucket conveyor and battery, with respect to the operational lights 318, 320 are illustrated. As long as light 318 is blinking, the operator knows the belt conveyor 68 is running. As long as light 320 is blinking, the operator knows the bucket conveyor 66 is running. When respective shafts 328 and 330 of the belt conveyor 68 and bucket conveyor 66 are turning, then their eccentric cams 333 are turning. Their cam action moves their respective actuator arms 334 turning respective light switches 336 off and on. Respective wiring circuits 324, 326, carry the oscillating currents to the operational lights 318, 320, and both wiring circuits are connected to a battery of the truck 40. Other components shown in FIGS. 26 and 27 are shaft bearing 338, bearing mounting plate 340, bolt assemblies 342, cam bolt 344, a switch bracket 346, and housing 130 of conveyor 66.

SOME GENERAL SPECIFICATIONS OF A SPECIFIC EMBODIMENT OF A DITCH CLEANER MOUNTED ON THE FRAME OF A FRONT CAB TRUCK

The front cab truck has a diesel engine with a responder transmission and an electric operated hydraulic shift control of a power take off shaft. The tires sizes are 12:00 × 20 in front, 10:00 × 20 in back. The debris collection chamber or box has an 8 to 10 cubic yard capacity and twin telescope hoists are used to dump the box. The overall weight of the truck is 19,990 pounds, without the ditch cleaner.

The ditch cleaner weighs 4860 pounds, and has a hydraulic tank capacity of 85 gallons. A hydraulic fluid filter is installed in the tank suction line and optionally another filter is installed in the return line. A double hydraulic fluid pump is powered by rotation of the power take off shaft. Both the auger and cleaner conveyor are driven by the same reversible hydraulic motor developing 740 foot pounds of torque at 2000 pounds per square inch. Timken bearings are used in this digging conveyor. Both the bucket and belt conveyors are each driven by a reversible hydraulic motor developing 300 foot pounds of torque at 1500 pounds per square inch. Also these conveyors include self align ball bearings. The buckets of the bucket conveyor are made of a heavy duty plastic.

During operations the forward truck speed is generally between 0 and 2 miles per hour as the truck engine runs at 1200 revolutions per minute. The depth of the ditches being cleaned may be 2½ feet deep and the lateral travel of the cleaning conveyor and the auger is 3 feet, with the extended reach from the truck wheel to the ditch centerline being 7½ feet. The retracted height of the ditch cleaner is 12 feet -8 inches and its width is 8 feet -0 inch.

BRIEF SUMMARY OF MAJOR ADVANTAGES OF USING THE DITCH CLEANER MOUNTED ON A VEHICLE

By mounting a ditch, shoulder of the road, and the road cleaner on a vehicle and during its operation moving its rotating auger along in an established roadside or irrigation ditch, the ditch is reclaimed, as debris is automatically loosened, removed, conveyed, and deposited, at selected locations clear of the ditch. Substantial overall savings over current ditch cleaning costs are realized upon operating this ditch cleaner. Moreover, roadside ditches are maintained better and often more frequently, thereby, avoiding the related costs, for example, of otherwise having to rebuild a road, where a wash out or partial wash out has occurred because of an unwanted water flow dam created by accumulated debris.

I claim:

1. A ditch cleaning mechanism for mounting on a vehicle to remove, debris from existing roadside ditches, comprising: a base adapted to be fixedly mounted on a vehicle extending transversely of the vehicle; a slide frame structure slidably and controllably positioned on the base, for movement transversely of the vehicle; a cleaning conveyor pivotally mounted at one of its ends on the slide frame structure for movement from an upright position for legal width highway travel to a selectable, variable downwardly extended position of its other end to approach and match the contour of a roadside ditch edge; an auger rotatably mounted on said other end of the cleaning conveyor and driven with the conveyor; a bucket conveyor mounted on said slide frame structure, and positioned during ditch cleaning operations to receive and to further raise the debris being raised by the cleaning conveyor, following the loosening of the debris upon the rotation of the auger along a bottom of a roadside ditch; a debris collecting chamber on said vehicle, and an essentially longitudinal belt conveyor mounted on said slide frame structure operable during ditch cleaning operations to receive the debris from the bucket conveyor and thereafter discharge the debris into said debris collecting chamber.

2. A ditch cleaning mechanism for mounting on a vehicle, as claimed in claim 1, having a power system comprising an internal combustion engine having a power take off shaft, a hydraulic system in turn driven by the power take off shaft, inclusive of conduit, a tank, filter, pump attached to the power take off shaft, valves and their controls to regulate the hydraulic fluid flows, hydraulic motor receiving the valve regulated hydraulic fluid flows and located respectively, to power the cleaning conveyor, to power the bucket conveyor, and to power the longitudinal belt conveyor, and hydraulic actuators receiving the valve regulated hydraulic fluid flows, and located respectively, to move the slide frame structure along the base, so the slide frame structure carries the auger, cleaning conveyor, bucket conveyor, and belt conveyor, transversely with respect to the vehicle, and to pivot the cleaning conveyor from a raised position maintained during higher speed highway travel to selected lower positions maintained during low speed ditch cleaning operations.

3. A ditch cleaning mechanism for mounting on a vehicle, as claimed in claim 1, wherein said cleaning conveyor and said bucket conveyor are substantially fully covered and having in addition a pivoting sealing means to prevent any debris from leaving the substantially fully covered conveyors during the transfer of the debris from the cleaning conveyor to the bucket conveyor, and during the raising of the cleaning conveyor to its highway travel position within the legal 8 foot width.

4. A truck having a ditch cleaning mechanism mounted on its frame between its front cab and a rear pivotal debris collecting chamber, comprising in addition to the conventional truck equipment, the ditch cleaning mechanism comprising, in turn: a base secured to the frame of the truck behind the front cab and in front of the rear pivotal debris collecting chamber, said base having a guideway extending transversely to the truck at an angle, whereby one of the ends of the guideway, to be nearer a roadside during ditch cleaning, is a lower end, and the other end of the guideway, to be nearer the center of a road during ditch cleaning, is a higher end; a slide frame structure slidably and controllably positioned on said guideway, and thereby also having a lower end and a higher end; said slide frame structure having an upstanding portion adjacent its higher end; a cleaning conveyor substantially fully covered to avoid any spillage of debris and pivotally mounted at one of its ends to the lower end of the slide frame structure for movement from an upright position for legal width highway travel to a selectable, variable downwardly extended position of its other end to approach and match the contour of a roadside ditch edge; an auger rotatably mounted on the downwardly extended end of the cleaning conveyor and driven with the conveyor; a bucket conveyor substantially fully covered to avoid any spillage of debris and angularly mounted on the upstanding frame portion of the slide frame structure, and positioned during ditch cleaning operations to receive and to further raise the debris being raised by the cleaning conveyor, following the loosening of the debris upon the rotation of the auger along a bottom of a roadside ditch; and an essentially longitudinal belt conveyor pivotally mounted on the slide frame structure and positioned during ditch cleaning operations to receive and to distribute the debris being first raised and then dropped by the bucket conveyor onto this longitudinal belt conveyor, which thereafter discharges the collected debris into said debris collecting chamber.

5. The combination according to claim 4 together with first power means for raising said debris collecting chamber to a dump position, second power means for pivoting said belt conveyor from an essentially horizontal position to an upper position to clear said debris collecting chamber when in dump position, and control means to prevent operation of said first power means except when said belt conveyor is in said upper position.

6. The combination according to claim 4 together with means for moving said slide frame structure carrying each of said conveyors along said guideway transversely of said truck.

* * * * *